United States Patent [19]

Irving

[11] 3,963,280

[45] June 15, 1976

[54] PUSHROD GUIDE AND LOCATOR

[75] Inventor: Philip Edward Irving, Warrandyte, Australia

[73] Assignee: Jeffrey Robert Hughes, Australia

[22] Filed: Feb. 5, 1975

[21] Appl. No.: 547,242

[30] Foreign Application Priority Data

Aug. 9, 1974 Australia ..... 65483/74

[52] U.S. Cl. ..... 308/5 V

[51] Int. Cl.[2] ..... F16C 29/02

[58] Field of Search ..... 308/5 V, 5 R

[56] References Cited

UNITED STATES PATENTS

| | | | |
|---|---|---|---|
| 1,469,270 | 10/1923 | Short | 308/5 V |
| 1,755,255 | 4/1930 | Griffith | 308/3 R |
| 2,367,836 | 1/1945 | Brown | 308/5 R X |

*Primary Examiner*—M. H. Wood, Jr.
*Assistant Examiner*—Gene A. Church
*Attorney, Agent, or Firm*—Cushman, Darby & Cushman

[57] ABSTRACT

A pushrod guide and locator comprising a plate having first and second planar portions; one planar portion has an aperture for mounting the plate to an internal combustion engine and the other has a slot in which a bush having a peripheral groove is received for reciprocal movement along the length of the slot; the bush has a bore for a pushrod to pass through and reciprocate in; the arrangement is such that the reciprocal movement of the bush that is permitted is in one and an opposite direction of the pushrod through the bush.

The plate is particularly intended for mounting to a stud on a cylinder head and the two planar portions have an angular and plane relation to one another appropriate to the position of mounting to the engine and the reciprocating movement of the pushrod.

The guide and locator is particularly applicable to performance engines.

9 Claims, 5 Drawing Figures

PUSHROD GUIDE AND LOCATOR

BACKGROUND OF THE INVENTION

FIELD OF THE INVENTION

This invention relates to a pushrod guide and locator and in a particular aspect it relates to a pushrod guide which is easily mounted to an existing internal combustion engine.

Many internal combustion engines are not provided with pushrod guides at all or such guides as may be provided depend merely on a line contact between the pushrod and a member forming part of, say, the cylinder head of the engine. In the former instance deformation and whip of the pushrod can occur and, in the latter instance, wear of the pushrod can occur.

The lack of adequate guiding for pushrods is a particularly bad deficiency with high performance engines such as those modified for racing but is also a problem with engines intended for private and commercial use.

The present invention has as one of its objects the provision of a pushrod guide and locator.

Another object of the invention is to provide a pushrod guide and locator which is simple but effective.

Yet another object of this invention is to provide a pushrod guide and locator which can be mounted on an existing engine without modification thereof.

SUMMARY OF THE INVENTION

The present invention provides a pushrod guide and locator comprising a plate having mounting means enabling it to be mounted to an engine and a bush for receiving a pushrod for reciprocating sliding movement therethrough; the plate and the bush having co-operating guide means mounting the bush to the plate, restricting the bush against movement in the directions of movement of the pushrod through the bush and mounting the bush for reciprocating movement in one and an opposite direction laterally of the movement of the pushrod through the bush.

The plate may have a plurality of such bushes and such guide means for each bush.

It is preferred that said mounting means includes an aperture in the plate.

The guide means may include groove means in one of the bush and plate and the other of the bush and plate has means receivable in said groove means. In an alternative the guide means includes a slot in the plate and the bush is provided with a peripheral groove in which the material of the plate defining the slot is received. Other arrangements of guide means such as deforming the plate to provide a guideway for a circular, square or rectangular plan bush may be used.

Preferably, the plate has two planar portions; one of said planar portions having an aperture therein serving as said mounting means and the other of said planar portions having a slot therein and wherein the bush is provided with a peripheral groove in which the material of the plate defining the slot is received. It is preferred that said planar portions have an angular and plane relationship to one another in accordance with the plane in which the said one of said planar portions is to be mounted and the reciprocating movement of the pushrod. Thus the plate may be twisted and/or the planar portions may be at whatever is the necessary angular relation. It is particularly preferred that said planar portions lie at an angle of from 0° to 15° to one another.

It is preferred that the plate has a plurality of such apertures, such slots and such bushes.

Specific constructions of pushrod guides and locators in accordance with the invention will now be described with the aid of the accompanying drawings.

DETAILED DESCRIPTION

Figure 1:
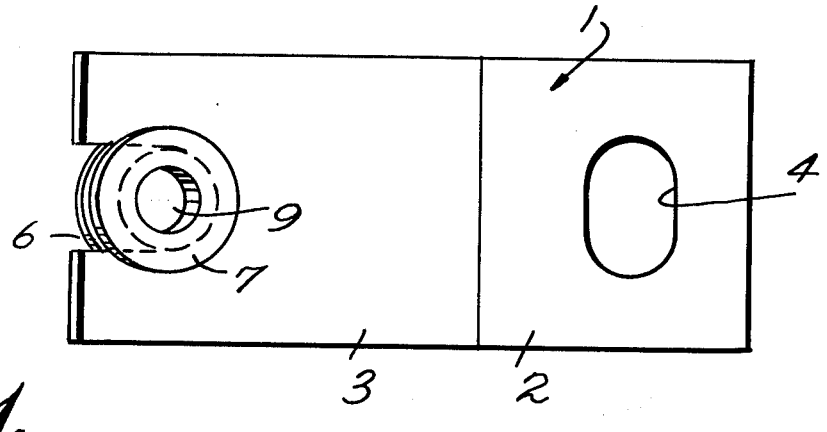
FIG. 1 is a plan view of a first pushrod guide and locator in accordance with this invention.
Figure 2:
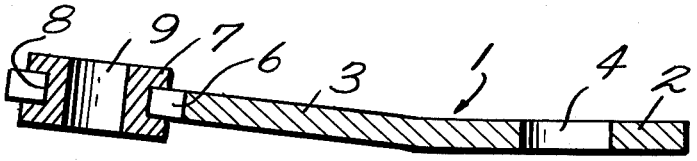
FIG. 2 is a side elevation of the guide shown in FIG. 1.

The pushrod guide and locator shown in FIGS. 1 and 2 comprises a mild steel plate indicated generally by 1 which has two planar portions 2 and 3 and which are inclined to one another at an angle.

The particular angle is appropriate to the engine with which the guide is to be used and for some engines the angle may, in fact, be 0° but, in general, will be from about 0° to about 10° and from about 3° to about 3° 30′ is most preferred for certain types of engine. However, in certain specific modes of mounting the plate, the angle may be up to 90°. This is discussed hereinafter.

The portion 2 is provided with an oval aperture 4 and the portion 3 is provided with a slot 6.

Received in the slot 6 is a bush 7 which has a peripheral groove 8 in its outside cylindrical surface and the material of portion 3 defining the slot is received in that groove. The dimensions of the groove 8 are chosen so that the bush is closely fitted to the portion 3 and is free to slide along the length of the slot 6.

The bush 7 has a central bore 9 of a size to receive a pushrod as a close fit therein and for reciprocating sliding movement of the pushrod through the bush in the directions of the axis of the bore 9.

The length of the portions 2 and 3 and the positioning of the aperture 4 and slot 6 is chosen to suit the engine with which the guide is to be used but applicant has found that many engines are suited by a guide wherein the distance from the centre of the aperture 4 to the closest adjacent portion of the slot 6 is about 0.62 inch and wherein the plate has a length of 1.5 inches.

It will be observed that the slot 6 opens to the perimeter of the plate 1.

The bush is made of any convenient metal suitable for use as a bearing and a preferred metal is bronze.

Figure 4:
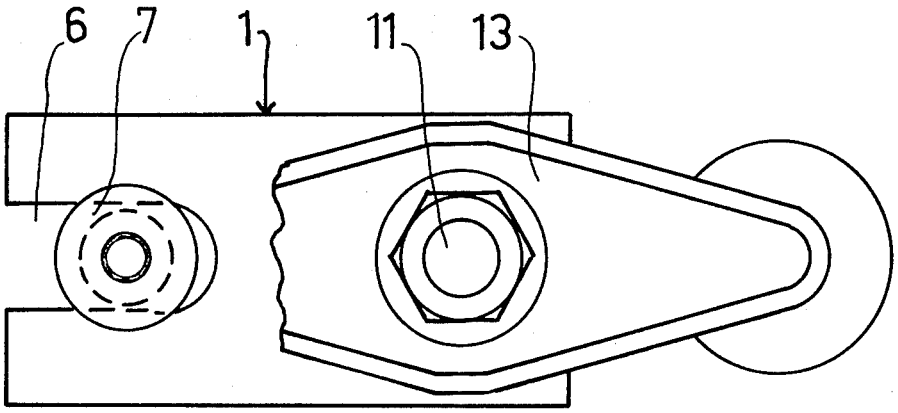
FIG. 4 is a plan view of the guide of FIG. 1, showing it in the mounted condition of FIG. 3.
Figure 3:
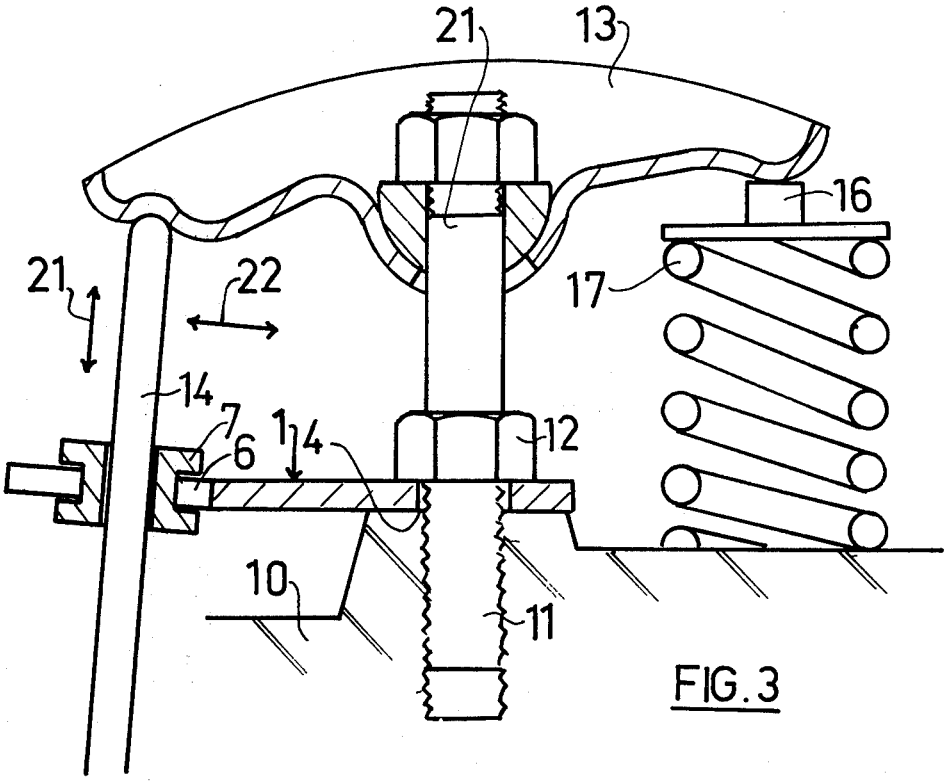
FIG. 3 is a side elevation of the guide of FIG. 1 showing it mounted to a cylinder head.

The guide shown in FIGS. 1 and 2 may be mounted to any convenient part of an engine but the preferred manner of mounting is shown in FIGS. 3 and 4.

In FIGS. 3 and 4, a cylinder head is shown in part as 10 and is provided with a rocker pedestal stud 11 which has a nut 12 thereon and which, at its upper end, supports a valve rocker arm 13. The rocker arm 12 is acted upon at one end by a pushrod 14 and at its other end it acts on the end 16 of a valve. A valve spring 17 is also shown.

The guide is positioned by the stud 11 passing through aperture 4 and is held down fast to the head 10 by the nut 12. The pushrod 14 passes through the bush 7 and is guided thereby. It is to be noted that the oval shape of aperture 4 permits a small amount of adjustment.

In use, the pushrod 14 reciprocaly moves through bore 9 in the bush 7 in the direction of arrows 20 and, because the rocker arm 13 pivots about a point 21, the pushrod will also move in the direction of arrows 22. Such movement of the pushrod in the direction of arrows 22 is permitted by the bush 7 sliding in the direction of the same arrows in slot 6 and the bush is itself supported by the location of the material of plate 1 defining the slot being located in the groove 8.

It will be noted that a projection of the pushrod 14 is at an angle to a projection of the stud 11 but this is accommodated by the angular relation of the portions 2 and 3. Further, the angle that the pushrod 14 makes with portion 3 will vary from the optimum 90° during operation but this variation is not considered to be sufficient to produce a material amount of wear or other detrimental effects particularly as the plate is preferably at 90° to the portion 3 at a position of the pushrod 14 corresponding to halfway between its limits of travel and thus angular relations varying between 88° and 92° and often better, are achievable.

As shown in FIGS. 3 and 4, the plate 1 is mounted to the rocker pedestal stud 11 but it is to be noted that it might also be mounted to a cylinder head stud or even to an inlet or outlet manifold stud or other engine part. For some such mountings, particularly those on a side of an engine, it may be necessary for portion 2 to have an angular relation to portion 3 of up to 90° and it even may be necessary for the plate to have a twist therein.

Figure 5:
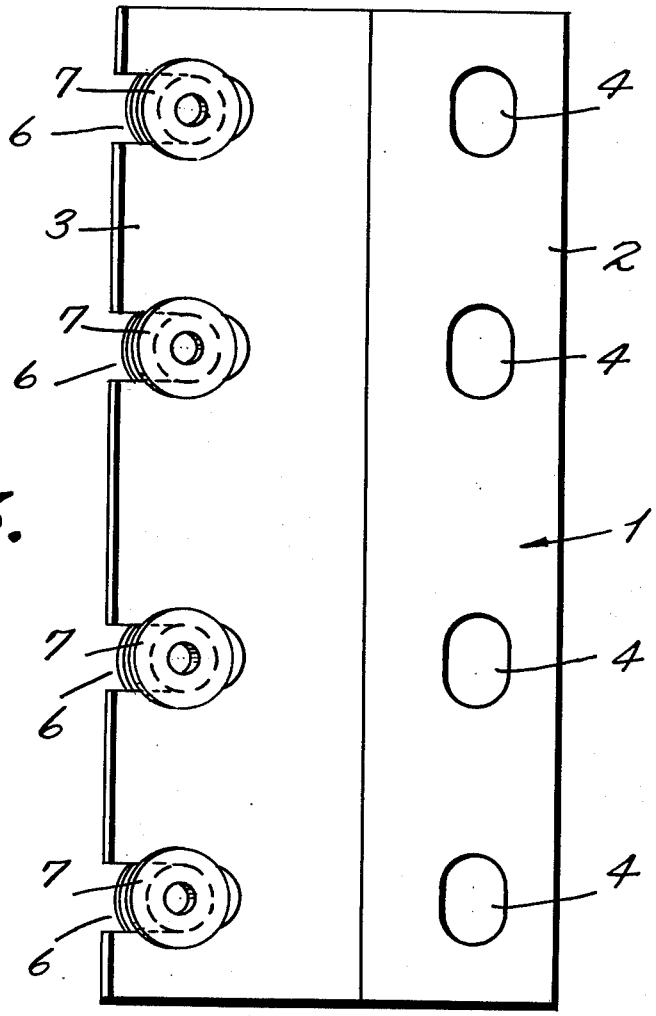
FIG. 5 is a plan view of a second pushrod guide and locator in accordance with this invention.

In FIG. 5 is shown another guide and locator which is similar in all respects to the guide of FIGS. 1 and 2 excepting that it has a plurality of apertures 4, slots 6 and bushes 7 so that it may guide a number of pushrods. Any number of bushes and slots may be provided but commonly will be one, two four and eight. Only so many apertures need be provided as is necessary for adequate mounting.

The guide of the present invention is able to be easily mounted to an engine and can be replaced in whole or in part at least as easily. It most satisfactorily guides and locates pushrods and reduces wear and other detrimental effects. The guide is of particular use for performance engines and has found wide application in V-8 engines.

I claim:

1. A pushrod guide and locator comprising a plate having mounting means enabling it to be mounted to an engine and a bush for receiving a pushrod for reciprocating sliding movement therethrough; the plate and the bush having co-operating guide means mounting the bush to the plate, restricting the bush against movement in the directions of movement of the pushrod through the bush and mounting the bush for reciprocating movement in one and an opposite direction laterally of the movement of the pushrod through the bush.

2. A pushrod guide and locator as claimed in claim 1, wherein said mounting means includes an aperture in the plate.

3. A pushrod guide and locator as claimed in claim 1, wherein said guide means includes groove means in one of the bush and plate and the other of the bush and plate has means receivable in said groove means.

4. A valve pushrod guide and locator as claimed in claim 1, wherein said guide means includes a slot in the plate and the bush is provided with a peripheral groove in which the material of the plate defining the slot is received.

5. A pushrod guide and locator as claimed in claim 1, wherein the plate has two planar portions; one of said planar portions having an aperture therein serving as said mounting means and the other of said planar portions having a slot therein and wherein the bush is provided with a peripheral groove in which the material of the plate defining the slot is received.

6. A pushrod guide and locator as claimed in claim 5, wherein said planar portions have an angular and plane relationship to one another in accordance with the plane in which the said one of said planar portions is to be mounted and the reciprocating movement of the pushrod.

7. A pushrod guide and locator as claimed in claim 5, wherein said planar portions lie at an angle of from 0° to 15° to one another.

8. A pushrod guide and locator as claimed in claim 1 having a plurality of such bushes and such guide means for each bush.

9. A pushrod guide and locator as claimed in claim 5, having a plurality of such apertures, such slots and such bushes.

* * * * *